US005107745A

United States Patent [19]

Utsumi

[11] Patent Number: 5,107,745

[45] Date of Patent: Apr. 28, 1992

[54] ELECTRONIC MUSICAL INSTRUMENT CAPABLE OF REPORTING OPERATING CONDITIONS INCLUDING SOUND LEVEL AND TEMPO

[75] Inventor: Naoto Utsumi, Hamamatsu, Japan

[73] Assignee: Kawai Musical Instruments Manufacturing Co., Ltd., Hamamatsu, Japan

[21] Appl. No.: 622,622

[22] Filed: Dec. 5, 1990

[30] Foreign Application Priority Data

Dec. 11, 1989 [JP] Japan ..... 1-320794

[51] Int. Cl.[5] ..... G10H 1/42; G10H 1/46; G10H 7/00

[52] U.S. Cl. ..... 84/612; 84/633; 84/DIG. 12

[58] Field of Search ..... 84/612, 633, 636, 652, 84/665, 668, 711, 714, 741, DIG. 12

[56] References Cited

U.S. PATENT DOCUMENTS 4,419,918 12/1983 Dyck et al. ..... 84/DIG. 12

4,530,267 7/1985 Garfield ..... 84/DIG. 12

*Primary Examiner*—Stanley J. Witkowski

*Attorney, Agent, or Firm*—Koppel & Jacobs

[57] ABSTRACT

An electronic musical instrument capable of reporting a sound level and a tempo to be set. When a particular sound level or a particular tempo is selected and set, a click having a particular pitch matching the sound level or the tempo is generated to allow the user to recognize the sound level or the tempo on the basis of the pitch of the click. The instrument has a right and a left loudspeaker and, when the sound level is high or the tempo is fast, produces louder sound from one of the loudspeakers while, when the sound level is low or the tempo is slow, producing louder sound from the other loudspeaker.

9 Claims, 7 Drawing Sheets

| TEMPO (♩=) | 48 | 52 | 56 | 60 | 64 | ----- | 236 | 240 |
|---|---|---|---|---|---|---|---|---|
| PITCH OF CLICK | C 1 | C#1 | D 1 | D#1 | E 1 | ----- | B 4 | C 5 |

ELECTRONIC MUSICAL INSTRUMENT CAPABLE OF REPORTING OPERATING CONDITIONS INCLUDING SOUND LEVEL AND TEMPO

BACKGROUND OF THE INVENTION

The present invention relates to an electronic musical instrument of the type generating tones by a digital procedure and, more particularly, to an electronic musical instrument capable of informing the user of a sound level or a tempo of an automatic accompaniment to be set by changing the pitch of a click to be generated by a tone generating section thereof or changing the sound levels coming out of a left and a right loudspeakers.

An electronic musical instrument of the type described has a sound level selector and a tempo selector each being implemented with a switch device. The sound level selector and tempo selector are operable to select a particular sound level and, when an automatic accompaniment is desired, a particular tempo therefor. The sound level and tempo selected by the user are displayed by LEDs (Light Emitting Diodes) or similar indicators, so that the user or player may recognize them immediately. However, many of popular-priced instruments are not provided with such indicators and, therefore, do not allow the user to see the sound level or the tempo by eyes. The instrument without the indicators simply produces a click from a tone generating section thereof as an answer to the operation of the sound level selector or that of the tempo selector. Specifically, the switch device constituting the sound level selector, for example, has two switches, i.e., an UP switch and a DOWN switch for turning the sound level up or down, as desired. Every time either one of the UP and DOWN switches is pressed by the user, the sound level is changed step by step in the associated direction. More specifically, every time one of the two switches is turned on, a tone having a fixed pitch and a fixed sound level is produced as a click. The user, therefore, cannot see the instantaneous sound level by hearing the click whose pitch and sound level are fixed, although the click may inform the user of the change of sound level by one step. This is also true with the tempo selector, i.e., the tempo selector cannot inform the user of the instantaneous tempo due to the click having a fixed pitch and a fixed sound level.

The instrument lacking the indicators as stated above has another drawback, as follows. When the user desires to play a certain program on the instrument by selecting a desired sound level and a desired tempo, the user who does not know the sound level or the tempo currently set has to start an automatic accompaniment and, while listening to it, operate the sound level selector and tempo selector. This procedure is not only time-consuming but also inaccurate since the number of times that the click is produced is the only information indicative of a sound level or a tempo.

SUMMARY OF THE INVENTION

It is therefore an object of the present invention to provide an electronic musical instrument which allows the user to easily see a sound level and a tempo currently set despite the absence of indicators, thereby facilitating the user's operations.

It is another object of the present invention to provide a generally improved musical instrument capble of reporting a sound level, tempo, etc.

In accordance with the present invention, an electronic musical instrument for generating tones by a digital procedure comprises a tone generating unit for generating a tone associated with a key selected, a selecting unit for selecting operating conditions in which the instrument should operate, an operating condition storage for storing each of the operating conditions, a click data storage for storing click data each being associated with respective one of the operating conditions and each having a plurality of pitches, and a control unit for controlling the tone generating unit, selecting unit, operating condition storage and click data storage such that click data matching an operating condition selected by the selecting unit is read out of the click data storage, and a click having a pitch represented by the click data is generated by the tone generating unit.

Also, in accordance with the present invention, an electronic musical instrument for generating tones by a digital procedure comprises a selecting unit for selecting operating conditions in which the instrument should operate, a right and a left loudspeaker situated respectively at the right-hand side and the left-hand side of the instrument, a right and a left tone generating unit for generating tones to be fed to the right and left loudspeakers, respectively, a right click data storage for storing click data each being associated with respective one of the operating conditions and representative of sequentially decreasing sound levels, a left click data storage for storing click data each being associated with respective one of the operating conditions and representative of sequentially increasing sound levels, and a control unit for controlling the selecting unit, right and left tone generating units, and the right and left click data storages such that click data associated with an operating condition selected by the selecting unit are read out of the right and left click data storages, and clicks each having a sound level represented by respective one of the click data are generated by the right and left tone generating units and then produced from the right and left loudspeakers, respectively.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENTS

Figure 1:
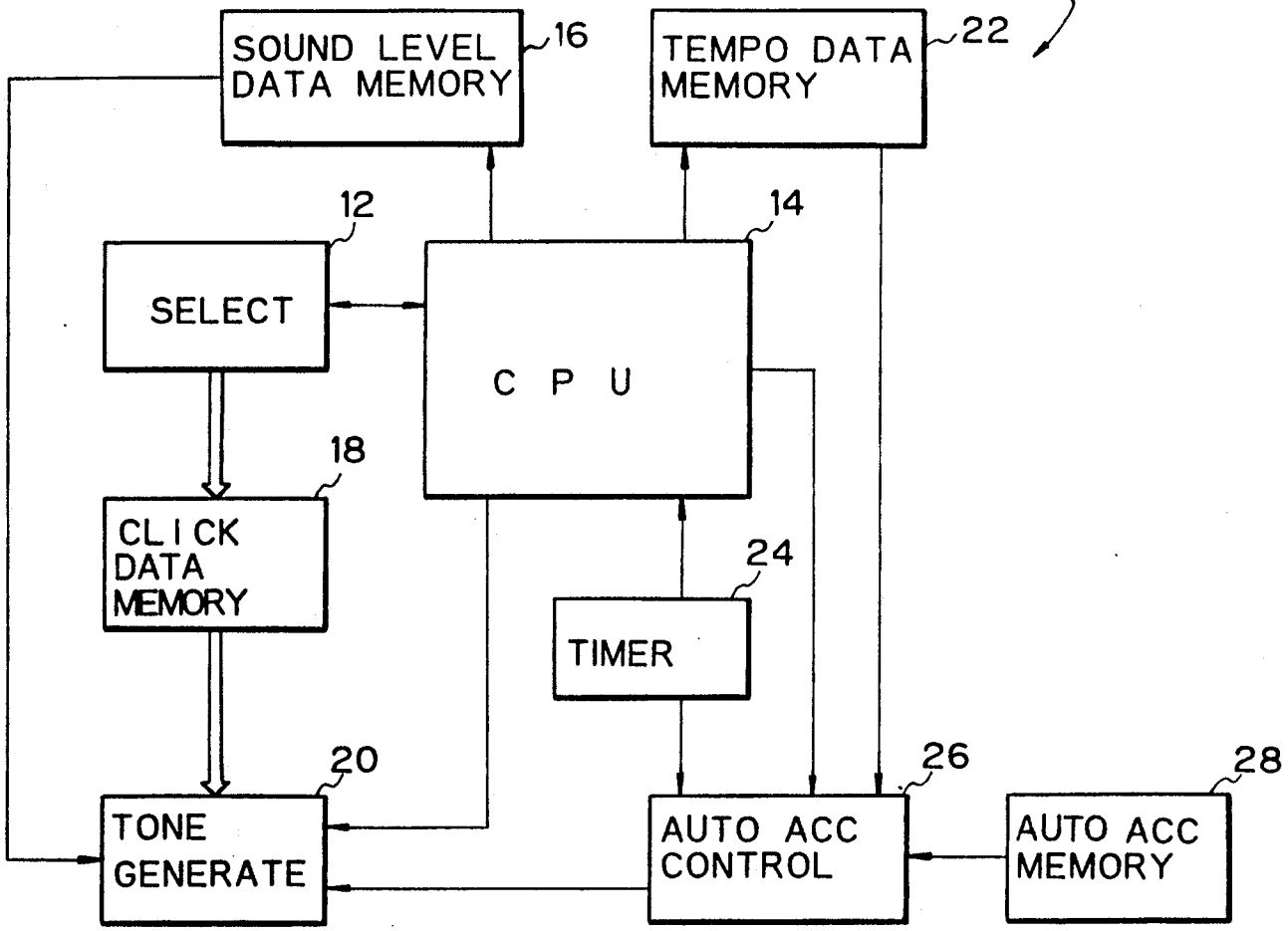
Fig. 1 PRIOR ART
FIG. 1 is a block diagram schematically showing a control system of a prior art electronic musical instrument.

To better understand the present invention, a brief reference will be made to a prior art electronic musical instrument, shown in FIG. 1. Specifically, FIG. 1 shows a control system installed in a prior art instrument for selecting and setting a sound level and a tempo. The control system, generally 10, has a selecting unit 12, a CPU 14, a sound level data memory 16, a click data memory 18, a tone generating unit 20, a tempo data memory 22, a timer 24, an automatic accompaniment (AUTO ACC) control unit 26, and an AUTO ACC data memory 28.

The selecting unit 12 has various switch devices necessary for playing the instrument and including switch devices which are accessible for selecting a particular sound level and a particular tempo, i.e. a sound level selector and a tempo selector. The sound level selector and tempo selector each has an UP switch and a DOWN switch. The CPU 14 scans the sound level selector or the tempo selector of the selecting unit 12 during the selection of a sound level or a tempo, producing a signal representative of a sound level or a tempo having been selected. The sound level data memory 16 is implemented as a ROM and stores data associated with sound levels. As the CPU 14 produces a signal representative of a particular sound level, corresponding data is read out of the memory 16. Likewise, the click data memory 18 is constituted by a ROM and stores data representative of a click having a fixed pitch and a fixed sound level. When the CPU 14 produces a signal in response to the operation of the selecting unit 12, the click data is read out of the memory 18. The tone generating unit 20 has a tone waveform memory, a digital-to-analog converter, an amplifier, loudspeakers, etc. When a particular key on the instrument is pressed, the tone generating unit 20 generates a corresponding tone. Also, the tone generating section generates tones represented by AUTO ACC data fed from the AUOT ACC control unit 26 or tempo data fed from the tempo data memory 22. Implemented as a ROM, the tempo data memory 22 stores various kinds of tempo data adapted for automatic accompaniments. When the selecting section 12 is operated to select a particular tempo, the CPU 14 reads associated tempo data out of the tempo data memory 22. The timer 24 counts time during a play or sets a tempo during an automatic accompaniment. The AUTO ACC control unit 26 combines the AUTO ACC data and the tempo data read out of the memories 28 and 22, respectively, and feeds the composite data to the tone generating unit 20. Comprising a ROM, the AUTO ACC data memory 28 stores data representative of various kinds of automatic accompaniment patterns. In response to the operation of the selecting unit 12, the CPU 14 reads data desired one of the patterns out of the AUTO ACC memory 28.

The instrument having the control system 10 reads the click data out of the click data memory 18 and thereby produces a click every time the sound level selector or the tempo selector of the selecting unit 12 is operated to change the sound level or the tempo step by step. A problem with such a prior art instrument is that since the clicks occurring at the successive steps have the same pitch and the same sound level, the user cannot accurately tell one sound level or tempo from another by hearing the clicks. Further, some of conventional electronic musical instruments are so constructed as not to generate a click when the sound level or the tempo has been set at the maximum or minimum level, despite the operation of the associated switches. In this type of instrument, when a click is not produced despite the operation of a particular switch, the user cannot tell whether the instrument is in a state wherein selections are inhibited or in a state wherein the power source is turned off.

Preferred embodiments of the electronic musical instrument in accordance with the present invention will be described hereinafter.

FIRST EMBODIMENT

Figure 2:
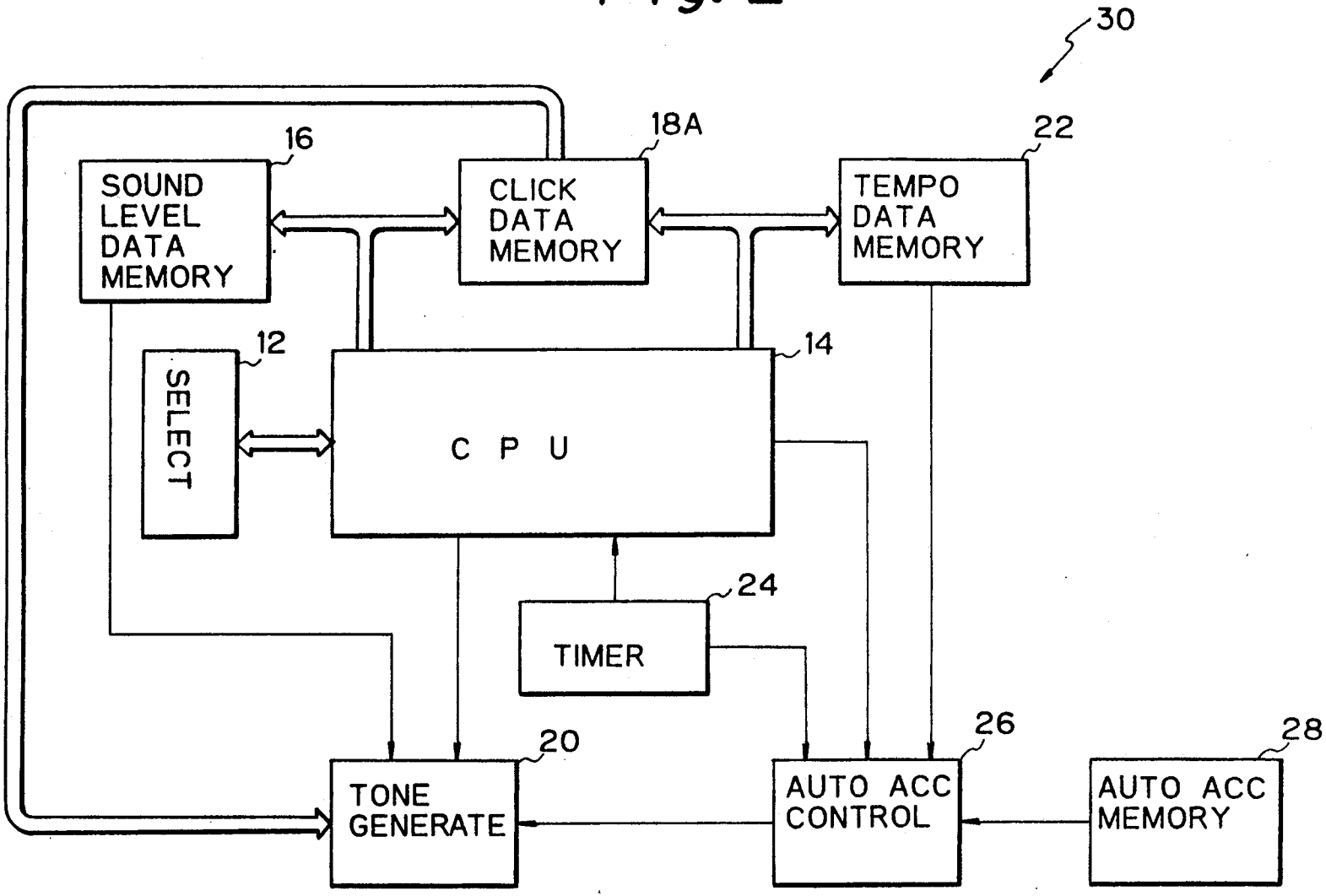
FIG. 2 is a block diagram schematically showing a control system representative of a first embodiment of the electronic musical instrument in accordance with the present invention.

Referring to FIG. 2, a control system representative of a first embodiment of the present invention will be described. In FIG. 2, blocks corresponding in function to the blocks shown in FIG. 1 are designated by the same reference numerals, and redundant description will be avoided for simplicity. As shown, the control system, generally 30, has a click data memory 18A which is different in function from the click data memory 18 of the prior art control system 10. Implemented as a ROM, the click data memory 18A stores data representative of clicks each having a particular pitch and each being assigned to a particular sound level or a particular tempo.

Every time the user presses an UP switch of a sound level included in a selecting unit 12 once in order to select a desired sound level, data representative of a click whose pitch is associated with a newly selected sound level is read out. This is also true with a DOWN switch associated with the above-mentioned UP switch. Likewise, every time the user presses an UP or a DOWN switch of a tempo selector also included in the selecting unit 12 once for the purpose of selecting a desired tempo for an automatic accompaniment, data representative of a click whose pitch matches a newly selected tempo is read out.

Figure 3:
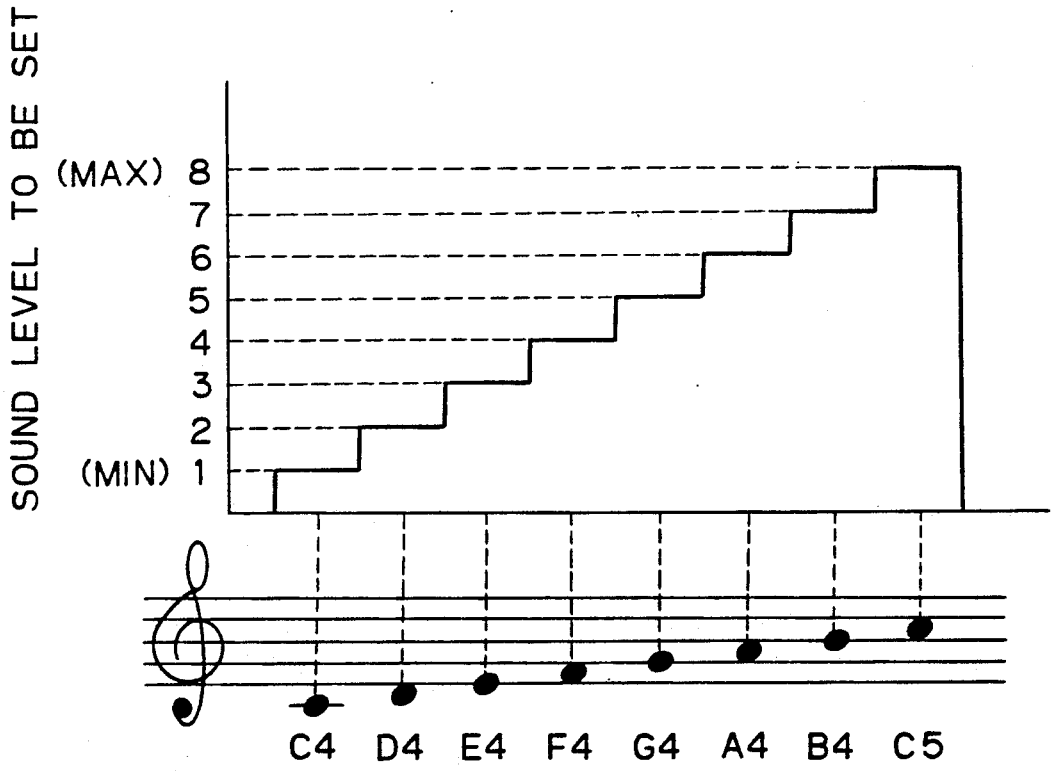
FIG. 3 shows a specific relation between the sound levels which may be selected and the pitches of a click.

FIG. 3 shows a specific relation between the sound levels which may be selected and the pitches of a click. Only eight sound levels (i.e. one octave) are shown in FIG. 3 for the ease of understanding. Specifically, a pitch "C4" is assigned to a sound level "1", i.e. minimum sound level. A pitch "D4" is assigned to a sound level "2" which is next to the sound level "1". Likewise, pitches "E4", "F4", "G4", "A4" and "B4" are assigned to sound levels "3", "4", "5", "6" and "7", respectively. Further, a pitch "C5" is assigned to a sound level "8", i.e. maximum sound level. Then, every time the UP switch or the DOWN switch of the sound level selector included in the selecting unit 12 is pressed once, a click whose pitch is associated with a newly selected sound level is generated. Assume that the sound level "2" has been set on the sound level selector. Then, as the user presses the UP switch of the sound level selector once, the sound level "3" is newly set while a click with the pitch "E4" is generated. As the UP swithc is repetitively operated in the same manner, the sound level is sequentially increased to "4", "5", "6" and so on with the clicks having the pitches "F4", "G4", "A4" and so on being generated one after another. When the DOWN switch of the sound level selector is operated, the sound level is sequentially lowered together with the pitch of the click. Of course, the number of sound levels shown and described is only illustrative and may be increased to sixteen or twenty-four, for example. Then, the range of pitches will also be incereased to extend over two or three octaves, for example. The pitch of the click may even be changed on a half tone basis in order to further increase the number of sound levels.

Figure 4:
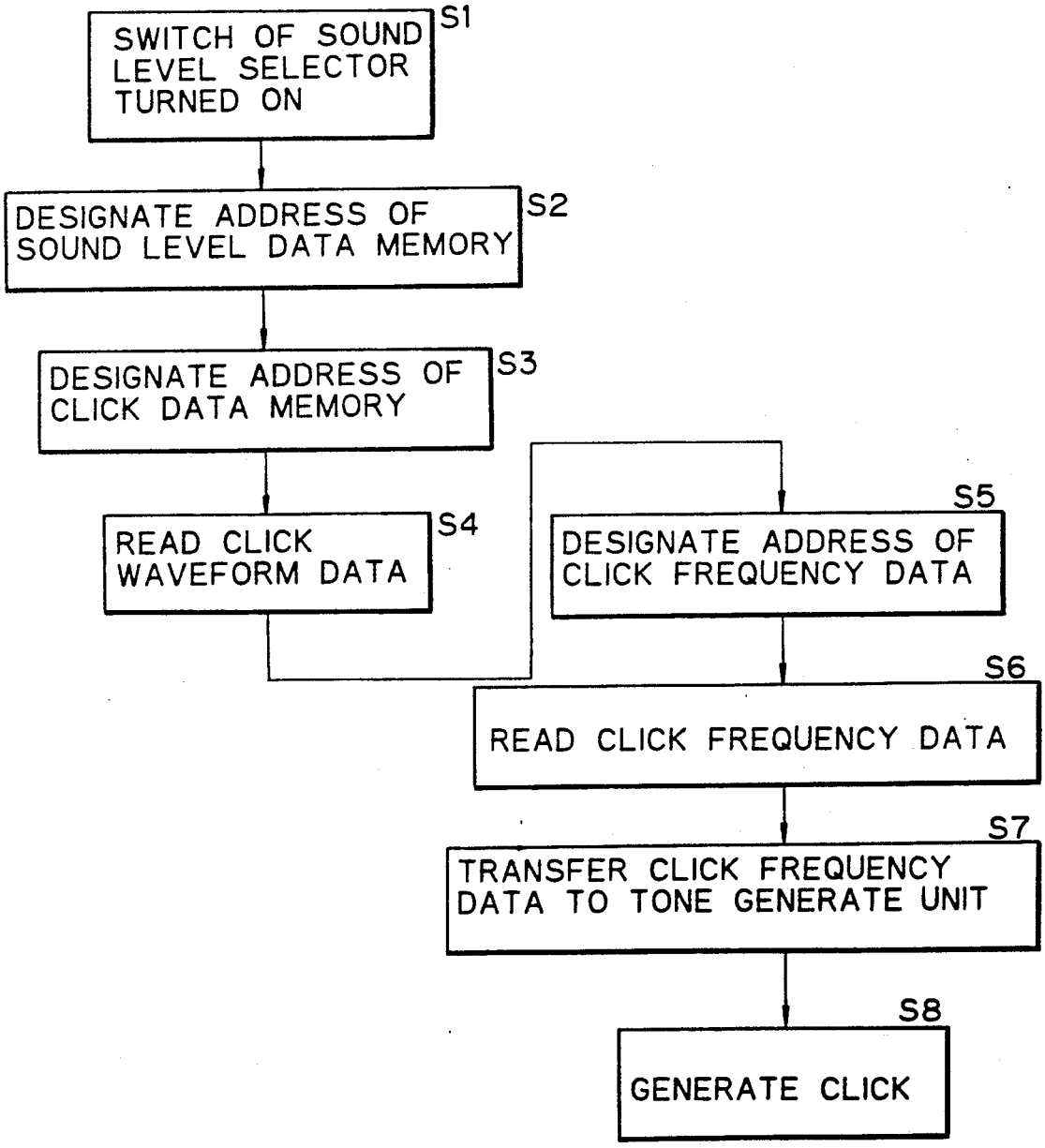
FIG. 4 is a flowchart demonstrating a specific operation of the embodiment for selecting and setting a particular sound level.

A reference will be made to FIG. 4 for describing how a sound level is selected and set in the illustrative embodiment. In the figure, the procedure begins with a step S1 in which either one of the UP and DOWN switches of the sound level selector is turned on. Then, the CPU 14, FIG. 2, determines the currently set sound level and a sound level to be newly set and designates a particular address of the sound level data memory 16 which stores sound level data (S2). Thereafter, the CPU 14 designates a particular address of the click data memory 18A which stores click waveform data (S3) and then reads out the click waveform data (S4). The CPU 14 designates an address of frequency data of a click (S5) and then reads it out (S6). The frequency data read out is transferred to the tone generating unit 20, FIG. 2 (S7). On receiving the frequency data, the tone generating unit 20 generates a click matching the frequency data (S8). By the sequence of steps S1 to S8 described above, a click whose pitch matches a sound level to be set anew is generated.

Figures 5, 6:
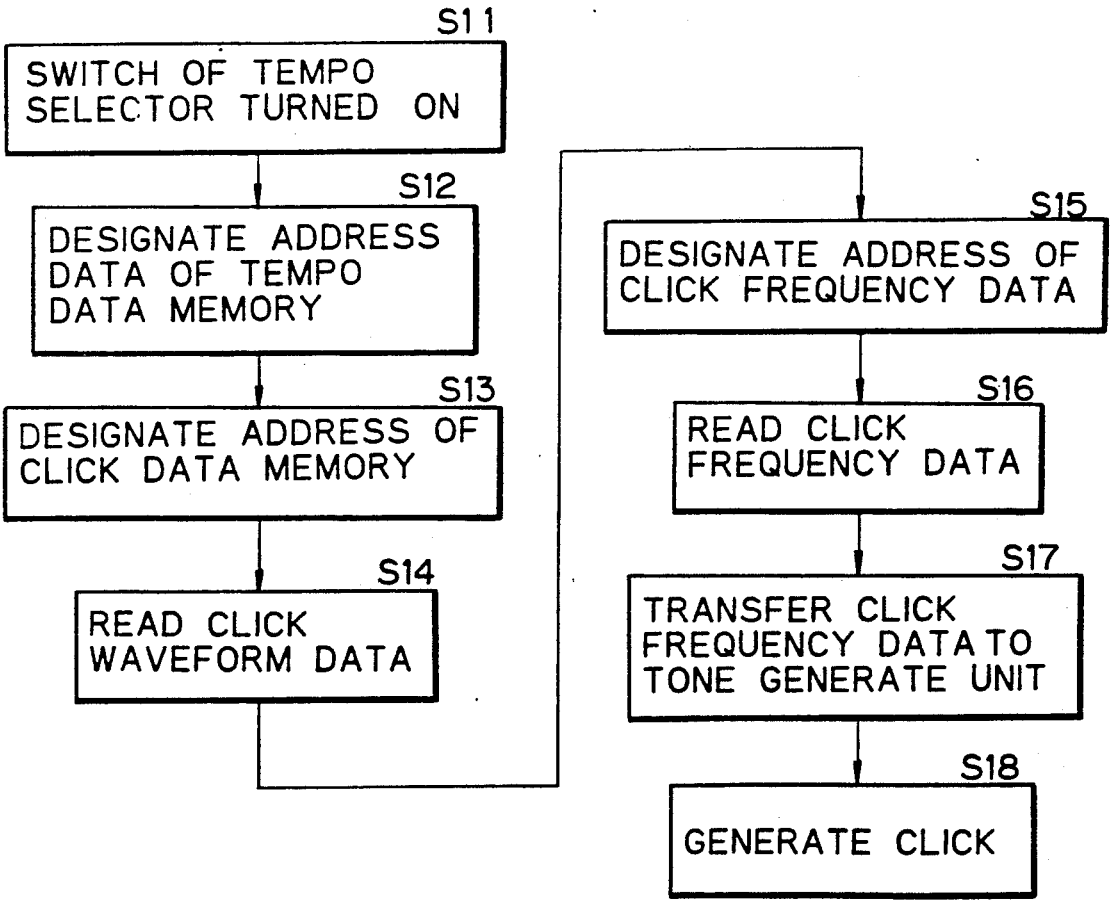
FIG. 5 lists a specific relation between the tempos which may be selected and the pitches of a click.
FIG. 6 is a flowchart representative of a specific operation of the embodiment for selecting and setting particular tempo.

FIG. 5 showns a specific relation between the tempos available for automatic accompaniments and the pitches of a click. The tempo is shown as being variable in forty-nine steps from "48" to "240", "4" at a time. In this example, four octaves of pitches "C1" to "B4" and a higher pitch "C5" each is assigned to respective one of the tempos "48" to "240". Particular one of such tempos is selected and set essentially in the same manner as the sound level, as follows. Assume that the DOWN switch of the tempo selector is pressed once when the currently set tempo is "60". Then, the temp "56" is newly set while a click having the pitch "D1" which is assigned to the tempo "56" is generated. As the DOWN switch is repetitively pressed, the tempos is sequentially lowered to "52" and then to "48" with clicks having pitches "C#1 and "C1" being generated one after another. Conversely, when the UP switch of the tempo selector is pressed once when the currently set temp is "60", the temp "64" is newly set while a click having the pitch "E1" is generated. By such an operation of the UP switch, the tempo is sequentially increased to "68", "72" and so on with clicks having pitches "F1", "F#1" and so on being generated in sequence.

FIG. 6 shows a procedure wherein a tempo is selected and set in the illustrative embodiment specifically. As shown, in a step S11, either one of the UP and DOWN switches of the tempo selector is turned on. Then, the CPU 14, FIG. 2, determines the currently set tempo and a temp to be newly set and designates an address of the tempo data memory 22 that stores tempo data (S12). The CPU 14 designates an address of the click data memory 18A which stores click waveform data (S13). Thereafter, the CPU 14 reads click waveform data out of the memory 18A (S14). The CPU 15 designates an address of click frequency data (S15) and then reads out particular click frequency data (S16). Subsequently, the CPU 15 transfers the click frequency data to the tone generating unit 20, FIG. 2 (S17). On receiving the click frequency data, the tone generating unit 20 generates a click represented by the received data (S18). By such a sequence of steps S11 to S18, a click whose pitch matches a tempo to be newly set is generated.

Since players in general are acoustically trained more than ordinary persons, they are capable of sharply distinguishing the clicks having different pitches and thereby recognizing the sound levels and the tempos with accuracy.

SECOND EMBODIMENT

Figure 7:
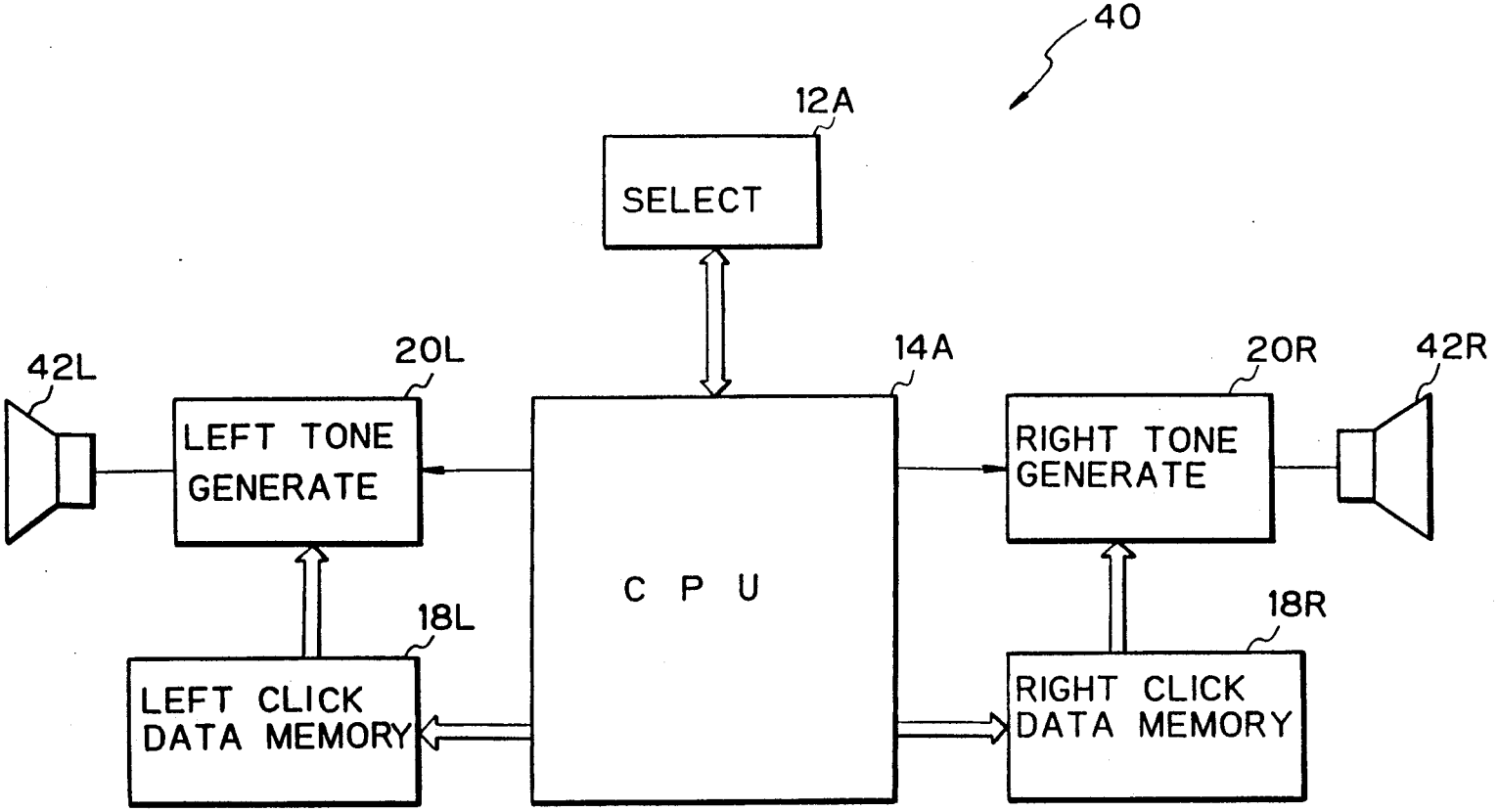
FIG. 7 is a block diagram schematically showing a second embodiment of the present invention.

This embodiment informs the user of a sound level or a tempo selected and set by changing the sound levels of clicks which come out of a left and a right loudspeaker included in the instrument. FIG. 7 shows a control system representative of this embodiment. As shown, the control system, generally 40, has a selecting unit 12A similar to the selecting unit 12 of FIG. 2, a CPU 14A, a right click data memory 18R, a left click data memory 18L, a right tone generating unit 20R, a left tone generating unit 20L, a right loudspeaker 42R, and a left loudspeaker 42L. The right and left tone generating units 20R and 20L play the role of sound sources for the right and left loudspeakers 42R and 42L, respectively. The click data memories 18R and 18L are respectively associated with the tone generating sections 20R and 20L, and each stores data representative of various sound levels of a click that match, for example, various sound levels which may be selected and set.

Figure 8A:
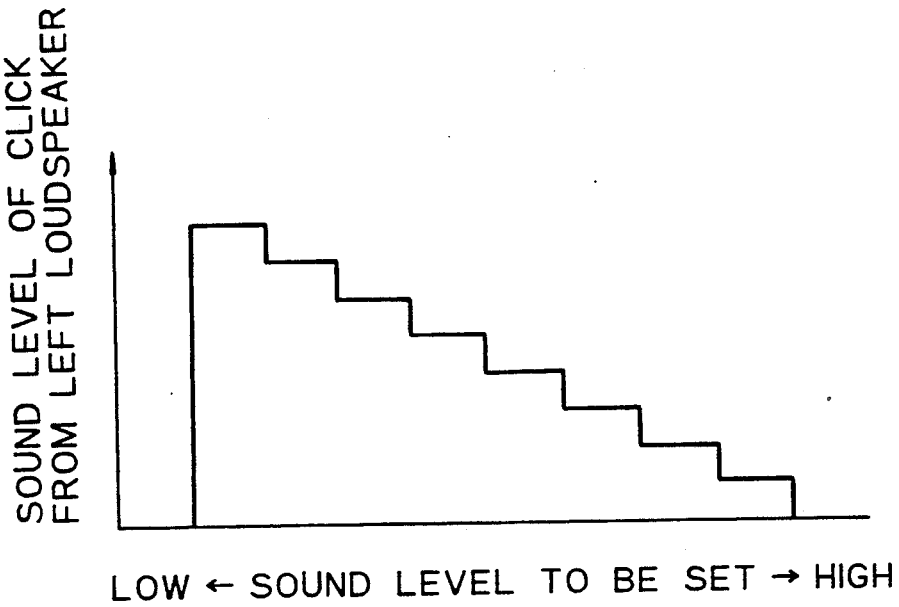
FIG. 8A is a graph showing a specific relation between the sound levels and the pitches of a click particular to the second embodiment, the click coming out of a left speaker.
Figure 8B:
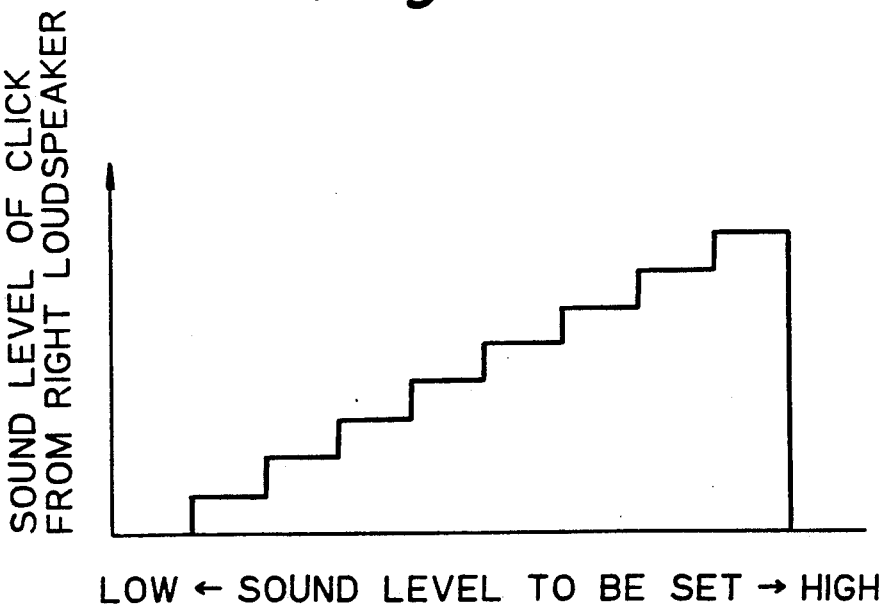
FIG. 8B is a graph similar to FIG. 8A, showing a specific relation between the sound levels and the pitches of a click which comes out of a right speaker.

FIG. 8A shows a specific relation between the sound levels which may be selected and set and the sound levels of a click to be produced from the left speaker 42L. FIG. 8B is a graph similar to FIG. 8A and associated with the right speaker 42R. As FIGS. 8A and 8B indicate, the illustrative embodiment assigns opposite relations between the sound levels to be set and the sound levels of the click to the right and left systems. Specifically, the clicks coming out of the right and left loudspeakers 42R and 42L are equal as to the sum of the sound levels. However, when the sound level selected and set is relatively low, the click coming out of the right loudspeaker 42R has a low sound level (FIG. 8B) while the click coming out of the left loudspeaker 42L has a high sound level (FIG. 8A). As the sound level to be set sequentially rises, the sound level of the click coming out of the right loudspeaker 42R rises (FIG. 8B) while the sound level of the click coming out of the left loudspeaker 42L falls (FIG. 8A). Therefore, when the minimum sound level is selected and set, the click is produced mainly from the left loudspeaker 42L. As the sound level is sequentially raised away from the minimum level, the click being produced from the right loudspeaker 42R becomes louder little by little. When the sound level of the click coming out of the right loudspeaker 42R sequentially increases, the user will see that the sound level is being increased step by step. Conversely, when the sound level of the click coming out of the left loudspeaker 42L sequentially increases, the user will see that the sound level to be set is being decreased step by step. The user or player, therefore, can recognize the sound level being set by hearing a change in the sound levels of the clicks being produced from the loudspeakers 42R and 42L.

In the illustrative embodiment, an ordinary volume switch is used to change the sound levels of the clicks which are produced from the right and left loudspeakers 42R and 42L. Specifically, the sound level to be set will increase when the volume switch is turned clockwise or decrease when the latter is turned counterclockwise. Of curse, such a relation is not limitative and may be reversed, if desired.

With this embodiment, a tempo can be selected and set in the same manner when an automatic accompaniment is desired. Specifically, for a slow tempo, for example, the sound levels of clicks coming out of the right and left loudspeakers 42R and 42L may be decreased and increased, respectively. This is also successful in allowing the user to recognize the tempo easily and accurately.

In the embodiments shown and described, the sound level to be selected and set is limited to the sound level of the entire musical instrument. Alternatively, the sound level may be selected and set for each of individual functions or factors including melodies and rhythms. Moreover, levels or values set by various kinds of switches other than those of the sound level selector and tempo selctor may also be reported by clicks having different pitches or by different sound levels of clicks coming out of a right and a left loudspeaker.

In summary, the present invention provides an electronic musical instrument which is extremely easy to operate since it allows the user to recognize a sound level or a tempo to be set with ease and accuracy without resorting to LEDs or similar indicators. Specifically, when the user operates any one of switches constituting a sound level selector or a tempo selector, the pitch of a click or the sound levels of clicks coming out of a right and a light loudspeaker are changed stepwise. In addition, in a digital electronic musical instrument, the control over the pitch of the click and the sound levels of the right and left loudspeakers can be readily implemented by software and, therefore, with a minimum of cost.

Various modifications will become possible for those skilled in the art after receiving the teachings of the present disclosure without departing from the scope thereof.

What is claimed is:

1. An electronic musical instrument for generating tones by a digital procedure, comprising:

tone generating means for generating a tone associated with a key selected;

selecting means for selecting operating conditions in which said instrument should operate;

operating condition storing means for storing each of said operating conditions;

click data storing means for storing click data each being associated with respective one of said operating conditions and each having a plurality of pitches; and control means for controlling said tone generating means, said selecting means, said operating condition storing means and said click data storing means such that click data matching an operating condition selected by said selecting means is read out of said click data storing means, and a click having a pitch represented by said click data is generated by said tone generating means.

2. An instrument as claimed in claim 1, wherein said operating conditions include a sound level of a tone to be produced from said instrument and a tempo for an automatic accompaniment.

3. An instrument as claimed in claim 2, wherein said selecting means comprises at least one of sound level switch means for selecting sound levels and tempo switch means for selecting tempos.

4. An instrument as claimed in claim 3, wherein said sound level switch means and said tempo switch means each comprises an UP switch and a DOWN switch.

5. An instrument as claimed in claim 3, wherein said operating condition storing means comprises at least one of a sound level data memory and a tempo data memory for storing sound level data and tempo data, respectively.

6. An electronic musical instrument for generating tones by a digital procedure, comprising:

selecting means for selecting operating conditions in which said instrument should operate;

tone generating means for generating tones;

click data storing means for storing click data each being associated with respective one of said operating conditions and representative of sequentially decreasing or increasing sound levels; and control means for controlling said selecting means, said tone generating means, and said click data storing means such that click data associated with an operating condition selected by said selecting means are read out of said click data storing means, and clicks each having a sound level represented by respective one of said click data are generated by said tone generating means.

7. An instrument as claimed in claim 6, wherein said operating conditions include a sound level of a tone to be produced from said instrument and a tempo for an automatic accompaniment.

8. An instrument as claimed in claim 7, wherein said selecting means comprises at least one of sound level switch means for selecting sound levels and tempo switch means for selecting tempos.

9. An instrument as claimed in claim 8, wherein said sound level switch means and said tempo switch means each comprises an UP switch and a DOWN switch.

* * * * *